US011310586B2

(12) United States Patent
Lambert et al.

(10) Patent No.: US 11,310,586 B2
(45) Date of Patent: Apr. 19, 2022

(54) NONLINEAR PORT PARAMETERS FOR VENTED BOX MODELING OF LOUDSPEAKERS

(71) Applicant: HARMAN INTERNATIONAL INDUSTRIES, INCORPORATED, Stamford, CT (US)

(72) Inventors: Russell H. Lambert, Highland, UT (US); Douglas J. Button, Simi Valley, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 368 days.

(21) Appl. No.: 16/160,678

(22) Filed: Oct. 15, 2018

(65) Prior Publication Data

US 2020/0120415 A1 Apr. 16, 2020

(51) Int. Cl.

| | |
|---|---|
| ***H04R 7/04*** | (2006.01) |
| ***H04R 1/28*** | (2006.01) |
| ***H04R 1/02*** | (2006.01) |
| ***H04R 9/02*** | (2006.01) |

(52) U.S. Cl.

CPC ..... *H04R 1/2823* (2013.01); *H04R 1/025* (2013.01); *H04R 7/04* (2013.01); *H04R 9/025* (2013.01)

(58) Field of Classification Search

CPC .. H04R 1/2815; H04R 1/2819; H04R 1/2823; H04R 1/2826; H04R 1/2849; H04R 1/025

USPC ..... 181/156; 381/59, 345, 349

See application file for complete search history.

(56) References Cited

U.S. PATENT DOCUMENTS

| | | | | |
|---|---|---|---|---|
| 2008/0219484 | A1* | 9/2008 | Strauss | H04S 7/30 381/300 |
| 2010/0046772 | A1* | 2/2010 | Veau | H03G 3/30 381/103 |
| 2014/0064518 | A1* | 3/2014 | Park | H03G 3/3005 381/107 |
| 2014/0098965 | A1* | 4/2014 | Wang | H04R 29/001 381/59 |
| 2018/0136899 | A1* | 5/2018 | Risberg | H04R 3/04 |
| 2019/0222939 | A1* | 7/2019 | Brunet | H04R 1/2834 |

FOREIGN PATENT DOCUMENTS

EP 3026931 A1 6/2016

OTHER PUBLICATIONS

Klippel, W., "Optimal Design of Loudspeakers With Nonlinear Control," AES 32nd International Conference, Sep. 21-23, 2007, Hillerod, Denmark, 11 pg.

(Continued)

*Primary Examiner* — Melur Ramakrishnaiah

(74) *Attorney, Agent, or Firm* — Brooks Kushman, P.C.

(57) ABSTRACT

A loudspeaker parameter system for vented box driver excursion modeling, may include a loudspeaker driver having a conductor, a magnet and a diaphragm. The system may further include a processor for excursion modeling configured to receive an input signal, determine a voltage level of the input signal, an enclosure having a resonant port, estimate port parameters including at least one of an acoustic resistance or acoustic mass, and apply a voltage limit based on the vented box excursion model utilizing the port parameters.

18 Claims, 7 Drawing Sheets

(56) References Cited

OTHER PUBLICATIONS

Thiele, A.N., "Loudspeakers in Vented Boxes: Part 1," Journal of the Audio Engineering Society, Audio Engineering Society, New York, NY, US, vol. 19, No. 5, May 1, 1971, pp. 382-392.
Thiele, A.N., "Loudspeakers in Vented Boxes: Part II," Journal of the Audio Engineering Society, Audio Engineering Society, New York, NY, US, vol. 19, No. 6, Jun. 1, 1971, pp. 471-483.
Klippel, W., "Prediction of Speaker Performance at High Amplitudes," AES, 60 E. 42nd Street, Room 2520, New York, NY 10165-2520, USA, Sep. 24, 1971, 14 pgs.

* cited by examiner

NONLINEAR PORT PARAMETERS FOR VENTED BOX MODELING OF LOUDSPEAKERS

TECHNICAL FIELD

Disclosed herein are non-linear port parameters for vented box modeling of loudspeakers.

BACKGROUND

Various methods and systems have been developed to protect loudspeakers with digital signal processing (DSP), including vented box loudspeakers. Various models have been developed to characterize the non-linearities of loudspeakers. The main sources of these nonlinearities may include a force factor, stiffness, inductance, and acoustic resistance and acoustic mass. Existing speaker limiters may limit peak or RMS voltages, but lack the proper information, including complete thermal and excursion models. These speaker limiters may be overly cautious in limiting and thereby prevent the loudspeaker form performing at the maximum output that it is capable of.

SUMMARY

A loudspeaker parameter system for vented box driver excursion modeling, may include a loudspeaker driver having a conductor, a magnet and a diaphragm. The system may further include a processor for excursion modeling configured to receive an input signal, determine a voltage level of the input signal, an enclosure having a resonant port, estimate port parameters including at least one of an acoustic resistance or acoustic mass, and apply a voltage limit based on the vented box excursion model utilizing the port parameters.

A method for modeling parameters of a vented box loudspeaker may include receiving an input signal, determining a voltage level of the input signal, interpolating port parameters including at least one of an acoustic resistance and acoustic mass, and applying a voltage limit based on the port parameters.

A loudspeaker parameter system may include a loudspeaker having a transducer and a diaphragm and a processor for excursion modeling. The processor may be configured to receive an input signal, determine the voltage level of the input signal, estimate an acoustic resistance, wherein the acoustic resistance and acoustic mass are voltage dependent, and apply a voltage limit to limit excursion based on the port parameters.

A loudspeaker parameter system for vented box driver excursion modeling may include a loudspeaker driver having a coil, a magnet and a diaphragm. The system may also include a processor for excursion modeling configured to receive an input signal, determine a voltage input of the input signal, estimate port parameters including an acoustic resistance and acoustic mass, and apply a voltage limit based on the vented box excursion model utilizing the nonlinear port parameters.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

Figure 1:
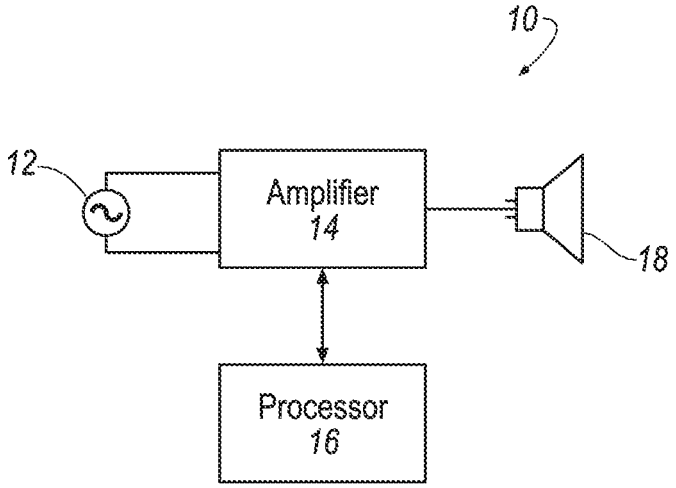
FIG. 1 illustrates an example speaker system.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

An electromagnetic loudspeaker may use magnets to produce magnetic flux in an air gap. A voice coil may be placed in the air gap. The voice coil may have cylindrically wound conductors. An audio amplifier is electronically connected to the voice coil to provide electrical signal that corresponds to a particular current to the voice coil. The electrical signal and the magnetic field produced by the magnets cause the voice coil to oscillate, and in turn, drive a diaphragm to produce sound.

However, loudspeakers have limits to their performance. Typically, as more power is applied to the speaker, the voice coil will heat up and eventually fail. This is due to the resistance of conductors generating heat. As the DC resistance (DCR) of the voice coil makes up a major portion of a driver's impedance, most of the input power is converted into heat rather than sound. Thus, as the temperature of the coil increases, the DCR of the coil will increase. The power handling capacity of a driver is limited by its ability to tolerate heat. Further, the resistance and impedance of the loudspeaker increases as the voice coil temperature increases. This may lead to power compression, a frequency dependent loss of expected output due to the rise in temperature of the voice coil and the DCR. As the DCR increases, the linear and non-linear behavior of the system changes. As more low frequencies are applied to a driver, a greater cone excursion is recognized. Loudspeakers have a finite amount of excursion capability before extreme distortion of the output occurs. In order to compensate for these changes, adjustments may be necessary, such as limiting the voltage input. In order to apply the appropriate adjustments, accurate prediction of the voice coil temperature and non-linear behavior of the of the cone excursion in real-time or near real-time may be necessary. Such predictions, with appropriate mitigating action, or voltage limiting, may allow the cone to reach a safe maximum excursion, and properly control over-excursion without creating undo distortion.

To achieve an accurate model of the voice coil temperature and the non-linear behavior of the cone excursion, the system includes a non-linear port parameter system. The system may accurately predict various port parameters such as acoustic resistance $R_a$ and acoustic mass $M_a$. These parameters have historically been assumed linear for modeling purposes for vented box loudspeakers. The system enables the accurate prediction of speaker voice coil excursion, improves speaker health and safety, and increases the sound quality at higher sound levels. An excursion limiter may limit the peaks of excursion so that the loudspeaker may be safely played at maximum loudness with minimal distortion. When only the peaks of the sound are limited, very little distortion is the result.

The port parameters may be determined using step-up measurements. A real-time model may be applied using the port parameters. When the system is in operation, an input voltage to the speaker may be used to compute the voltage envelope. The voltage envelope may be used to lookup the instantaneous acoustic resistance $R_a$ and the acoustic mass $M_a$ values for the specific voltage level. Unlike traditional modeling, the acoustic resistance $R_a$ and the acoustic mass $M_a$ may be vary and be voltage dependent. The port parameter values may then be sent through a lumped element model to predict the excursion of the voice coil. The excursion envelope is then used to limit the speaker in an optimal way that limits only the peaks and creates minimal distortion with the possibility for maximum sound output without causing damage to the speaker.

Thus, the acoustic resistance $R_a$ and the acoustic mass $M_a$ may be used for accurate prediction of voice coil displacement, current, and velocity, for vented box loudspeakers having ports. The system may be applicable to both low level linear ranges of the port, and high level, nonlinear ranges of the ports. The system may not require measurements at the ports via heat wire sensors or other methods in order to acquire acoustic resistance $R_a$ and acoustic mass $M_a$. The port parameters maybe mapped as a function of input voltage level.

FIG. 1 illustrates an example speaker system 10 including an audio source 12 that is configured to transmit an audio signal to an amplifier 14 and a loudspeaker 18. One or more controllers, hereinafter the "controller 16" may be in communication with the amplifier 14. The controller 16 may be generally coupled to memory for operation of instructions to execute equations and methods described herein. In general, the controller 16 is programmed to execute the various methods as noted herein. The controller 16 may include the models described herein. The controller 16 may modify an audio signal based on the temperature and nonlinearities of the loudspeaker. The loudspeaker 18 may include one or more drivers including a horn driver (or high frequency (HF) driver) and/or woofer to reproduce the audio signal. The drivers included and described herein are exemplary and not intended to be limiting. Other drivers may be included having various frequency ranges. The loudspeaker 18 may include a cone and a voice coil.

The loudspeaker 18 may include a magnet, a back plate, a top plate, a pole piece, and a voice coil. The voice coil may comprise of a wire such as an insulated copper wire (i.e., voice coil or coil) wound on a coil former. The voice coil may be centered with a magnetic gap. The voice coil may be configured to receive a signal from the amplifier 14. This signal may create an electrical current within the voice coil. The magnetic field in the magnetic gap may interact with the current carrying voice coil thereby generating a force. The resulting force may cause the voice coil to move back and forth and consequently displacing the cone from its rest position. The motion of a speaker cone moves the air in front of the cone, creating sound waves, thus acoustically reproducing the electrical signal.

The loudspeaker 18 includes the speaker cone (or diaphragm) extending radially outward from the coil creating a conical or dome-like shape. The center of the cone near the voice coil may be held in place by a spider. The spider and surround together generally allow only for axial movement of the speaker cone. During operation, and while the electrical current is being driven through the coil, the coil may move axially causing movement of the cone (i.e., cone excursion). The cone excursion or displacement x, in general, is the distance that the cone moves from a rest position. The distance from the rest position varies as the magnitude of the electric signal supplied to the coil changes. For example, the coil, upon receiving an electronic signal with a large voltage, may cause the coil to move out of or further into the magnetic gap. When the coil moves in and out of the magnetic gap, the cone may be displaced from the cone's rest position. A large voltage may create a large cone excursion which in turn can cause the nonlinearities inherent in the transducer to become dominant.

As the excursion or displacement of the cone x increases, the surround and spider may become progressively stiffer. Due to the increasing stiffness $K_{ms}$, more force, and consequently larger input power may be required to further increase the excursion of the cone. Furthermore, as the cone moves into the enclosure, the air inside the box may be compressed and may act as a spring thereby increasing the total stiffness $K_{ms}(x)$. The inductance $L_e$ of the coil may also be affected by the electronic signal. The variation of the inductance $L_e$ of the voice coil represents the displacement dependent nonlinear behavior of the inductance, $L_e(x)$.

Figure 2:
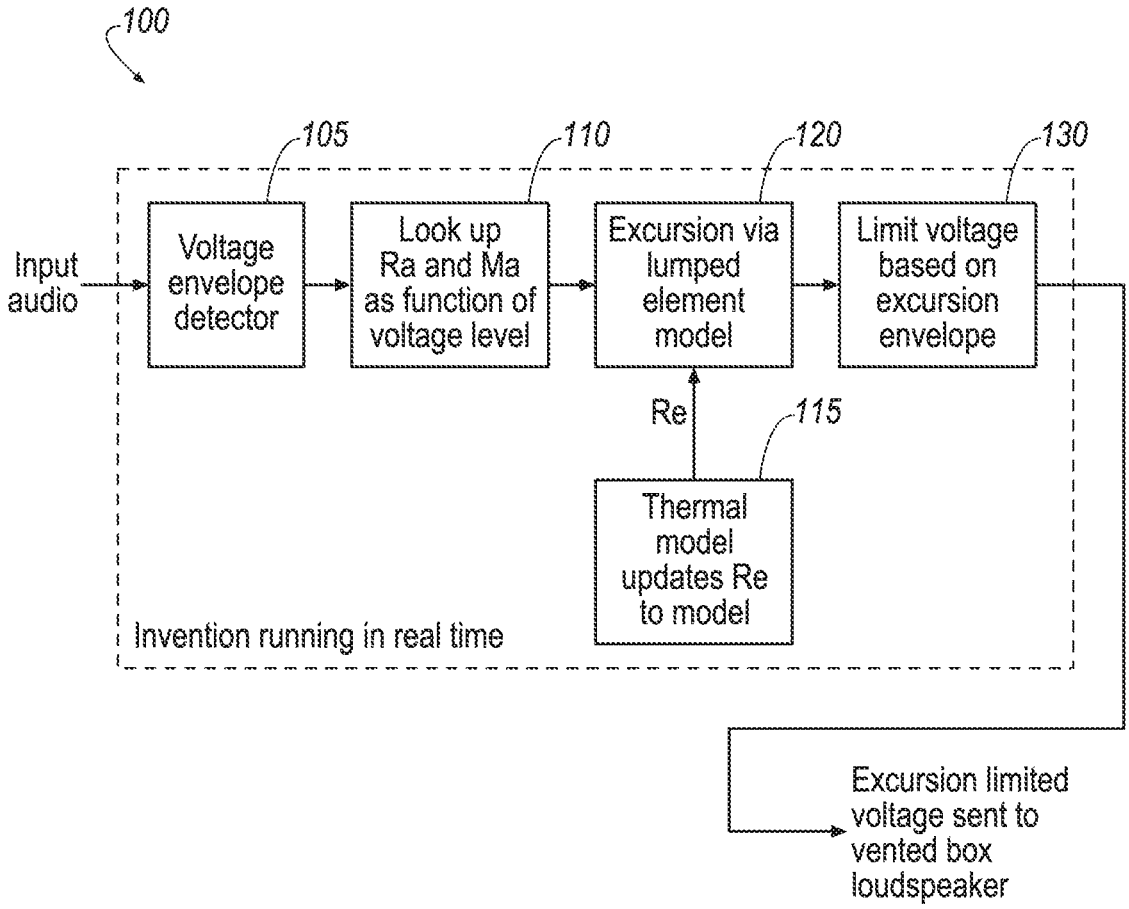
FIG. 2 illustrates an example excursion modeling system for a vented box system.

FIG. 2 illustrates an example excursion modeling system 100 for a vented box system. The system 100 may be carried out by the controller 116 of FIG. 1. The system 100 may include a voltage envelope detector block 105 configured to receive an input audio signal. The input audio signal may be a test signal or multilevel test signal. The input audio signal may be used to record displacement, AC voltage, DC voltage, AC current and DC current. From these parameters, the Rdriver, R_dc, and R_residual may be computed. Subsequently, the delta temperature may be computed, as well as the $R_e$, Impedance, and power compression.

Figure 3:
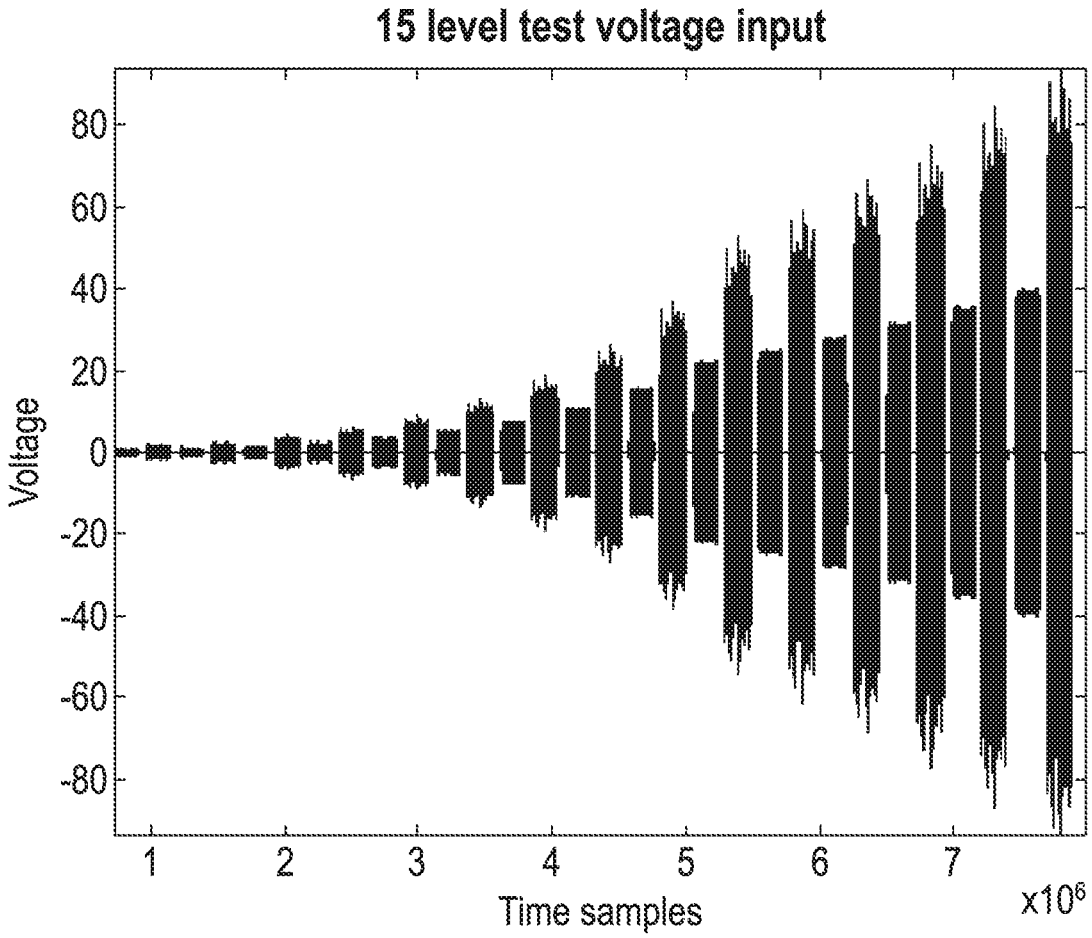
FIG. 3 shows an example input voltage test signal used to characterize the speaker and port parameters.

FIG. 3 shows an example input voltage test signal used to characterize the speaker and port parameters. The signal is made up of 4 seconds pink noise followed by 4 seconds of a swept sine (from 20 to 1000 Hz) and these are repeated 15 times at increasing levels up to the maximum usable range for the speaker to be modeled.

Returning to FIG. 2, the voltage envelope detector block 105 may determine the voltage envelope of the input audio and provide the voltage envelope of the input audio to a look-up function block 110.

The look-up function block 110 may include a look-up function for the port parameters such as the acoustic resistance $R_a$ and acoustic mass Ma. The voltage envelope may be used by the model 120 (as shown in FIG. 2) to determine the instantaneous acoustic resistance $R_a$ and the acoustic mass $M_a$ values for the specific voltage level. The port parameters may be interpolated from the voltage envelope via a look-up table, and/or a smooth function, curve-fit of the measured $R_a$ and $M_a$ values as a function of voltage level.

In the example of a look-up table, the look-up table may use the voltage level of the audio input to determine the instantaneous acoustic resistance $R_a$ and acoustic mass $M_a$.

Figure 4A:
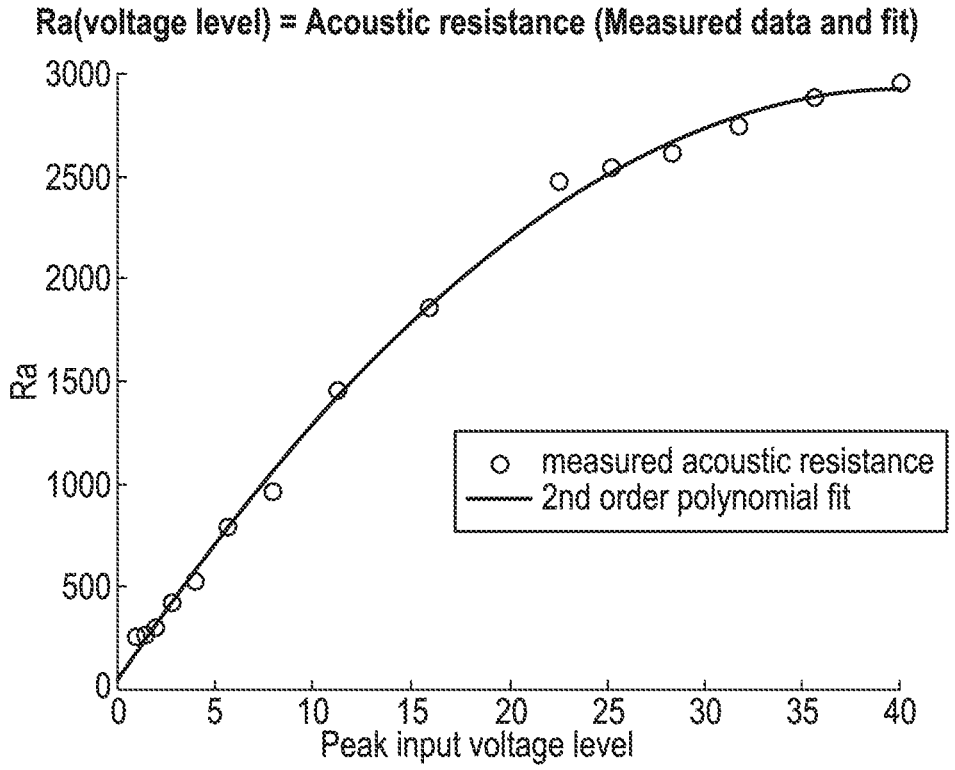
FIG. 4A illustrates an example plot of acoustic resistance over peak input voltage.
Figure 4B:
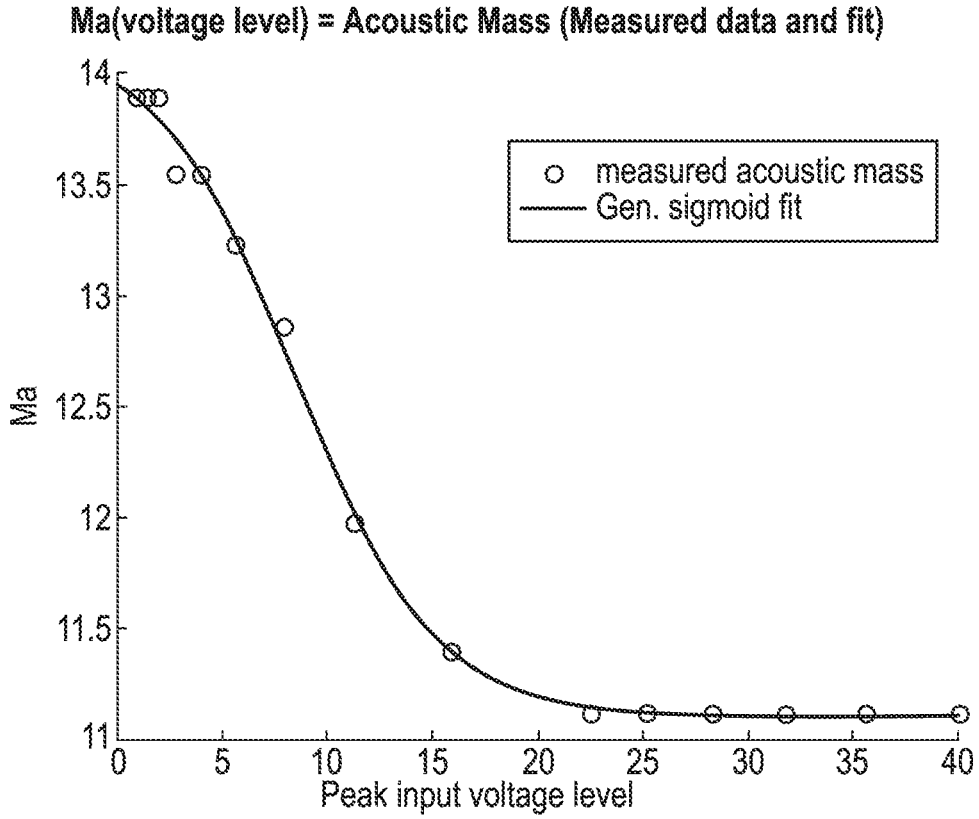
FIG. 4B illustrates an example plot of acoustic mass over peak input voltage.

FIGS. 4A and 4B illustrate examples of smooth functions of the acoustic resistance and mass. FIG. 4A illustrates an example plot of acoustic resistance versus peak input voltage. Optimal values for $R_a$ were found at each of the 15 levels in the input test signal shown in FIG. 3. The 15 optimal values were then curve-fit using a second order polynomial. The acoustic resistance $R_a$ may be determined for a voltage level based interpolated values or via the curve-fitted polynomial function.

FIG. 4B illustrates an example plot of acoustic mass versus peak input voltage. The plot may be modeled using some type of general function such as a polynomial or sigmoid. Again, optimal vales for $M_a$ were found at each of the 15 voltage levels in the input test signal shown in FIG. 3. The 15 optimal values were then curve-fit using, in this case, a generalized sigmoid function. The acoustic mass $M_a$ may be determined for the voltage level based on interpolated values or via the curved-fitted sigmoid function.

Returning back to FIG. 2, a lumped element model 120 may use the port parameters determined in the look-up function block 110 to determine the voice coil excursion. The model 120 may receive an electrical resistance Re from a thermal model block 115. The thermal model block 115 may update the excursion model with an updated resistance $R_e$.

A simplified recursive model for a vented box may be include a 'voltage' lumped element equation and is illustrated below. This example is merely that, and other forms and versions are possible. Further, the Le and its derivative may be removed from these equations.

$$U = R_e i + \frac{dLe(x)}{dx} ix' + i' Le(x) + Bl(x)x';$$

and a

'force' lumped element equation:

$$Bl(x)i = Mms\, x'' + Rms\, x' - \frac{i^2}{2}\frac{dLe(x)}{dx} + Kms(x)x + S_d p.$$

The volume velocity may be represented by:

$$M_a q' = -R_a q + p,$$

the acoustic pressure:

$$C_b p' = -q + S_d x';$$

current:

$$i(n) = \left(U(n) - Bl(x)x' - x'\frac{dLe(x)}{dx} i(n-1) + \frac{Le(x)}{dt} i(n-1)\right) \Big/ \left(R_e + \frac{Le(x)}{dt}\right);$$

volume velocity:

$$q(n) = -\frac{R_a(U_{pk})}{M_a(U_{pk})} q(n-1)dt + \frac{p(n-1)}{M_a(U_{pk})} dt + q(n-1);$$

acoustic pressure:

$$p(n) = -\frac{q(n)}{C_b} dt + \frac{S_d}{C_b}(x(n) - x(n-1))dt + p(n-1);$$

force for displacement:

$$x(n+1) = \frac{\left(Bl(x)i - Rms\, x' - x(n)Kms(x) + \frac{i^2 dLe(x)}{2\, dx} - S_d p(n)\right)}{Mms\, dt^2} + 2x(n) - x(n-1);$$

$$x'' = \frac{x(n-1) - 2x(n) + x(n+1)}{dt},$$

where, Bl(x), Kms(x), Le(x), $$\frac{dLe(x)}{dx}$$

are force, stiffness, inductance and the derivative of inductance which are all functions of displacement x and dt=1/sample rate of audio;

$R_{ms}$ is mechanical resistance;

$M_{ms}$ is voice coil diaphragm mass;

$R_e$ is the DC resistance of voice coil;

$S_d$ is the area of the transducer;

$C_b$ is the acoustic compliance, additionally or alternatively, the reciprocal acoustic stiffness $K_b$ may be used;

$M_a(U_{pk})$ is the acoustic mass assumed to be a function of input voltage level; and $R_a(U_{pk})$ is the acoustic resistance assumed to be a function of input voltage level. The simplified recursive form may use fewer computational resources over traditional methods.

A state space model for a vented box may be represented by an X column state vector of 5 states, including displacement x, velocity x', current i, volume velocity q, and pressure p.

u(n) is the input voltage, where:

$$F = \begin{bmatrix} 1 & dt & 0 & 0 & 0 \\ -\frac{Kms(x)}{M_{ms}}dt & 1-\frac{R_{ms}}{M_{ms}}dt & \frac{Bl(x)}{M_{ms}}dt + \frac{\frac{dLe(x)}{dx}i}{2M_{ms}}dt & 0 & -\frac{s_d}{M_{ms}}dt \\ 0 & -\frac{\frac{dLe(x)}{dx}i + Bl(x)}{Le(x)} & 1-\frac{R_e}{Le(x)}dt & 0 & 0 \\ 0 & 0 & 0 & 1-\frac{R_a(U_{pk})}{M_a(U_{pk})}dt & \frac{dt}{M_a(U_{pk})} \\ 0 & \frac{s_d}{C_b}dt & 0 & -\frac{dt}{C_b} & 1 \end{bmatrix}$$

and $$G = \begin{bmatrix} 0 \\ 0 \\ \frac{dt}{L_e(x)} \\ 0 \\ 0 \end{bmatrix}$$

The state vector is updated via:

$$X(n+1)=F*X(n)+G*u(n)$$

$$i=X(3,n).$$

Here Bl(x), $K_{ms}$(x), $L_e$(x), $$\frac{dL_e(x)}{dx}$$

are force, stiffness, inductance and the derivative of inductance which are all functions of displacement x.

dt=1/sample rate of audio.

$U_{pk}$—peak voltage envelope detected from input voltage.

$M_a(U_{pk})$ is the acoustic mass in kg/m$^4$ which is a function of input voltage level; and $R_a(U_{pk})$ is the acoustic resistance in N·s/m$^5$ which is a function of input voltage level.

State space modeling may require matrix multiplies.

The non-linear parameters from the lumped element model 120 may be used at block 130 to limit the voltage based on the excursion envelope. Such limits may protect the voice coil of the loudspeaker from having a large displacement, which could lead to permanent damage of the loudspeaker.

In general, the model may use an average DC resistance (DCR) over a test signal to find the linear parameters first. The linear parameters may include Bl, $K_{ms}$, $L_e$, $M_{ms}$, $R_{ms}$, $M_a$, $R_a$, and $C_b$. Next, the model may estimate the non-linear parameters, including DCR, fixed $S_d$, $M_{ms}$, $K_{ms}$, $C_b$, $L_e$, and Bl. The non-linear parameters may also include, but not limited to, adapting Bl, $K_{ms}$ and $L_e$ parameters. In the vented box, the acoustic resistance $R_a$ and acoustic mass $M_a$ may be adapted per the methods above.

Figure 5A:
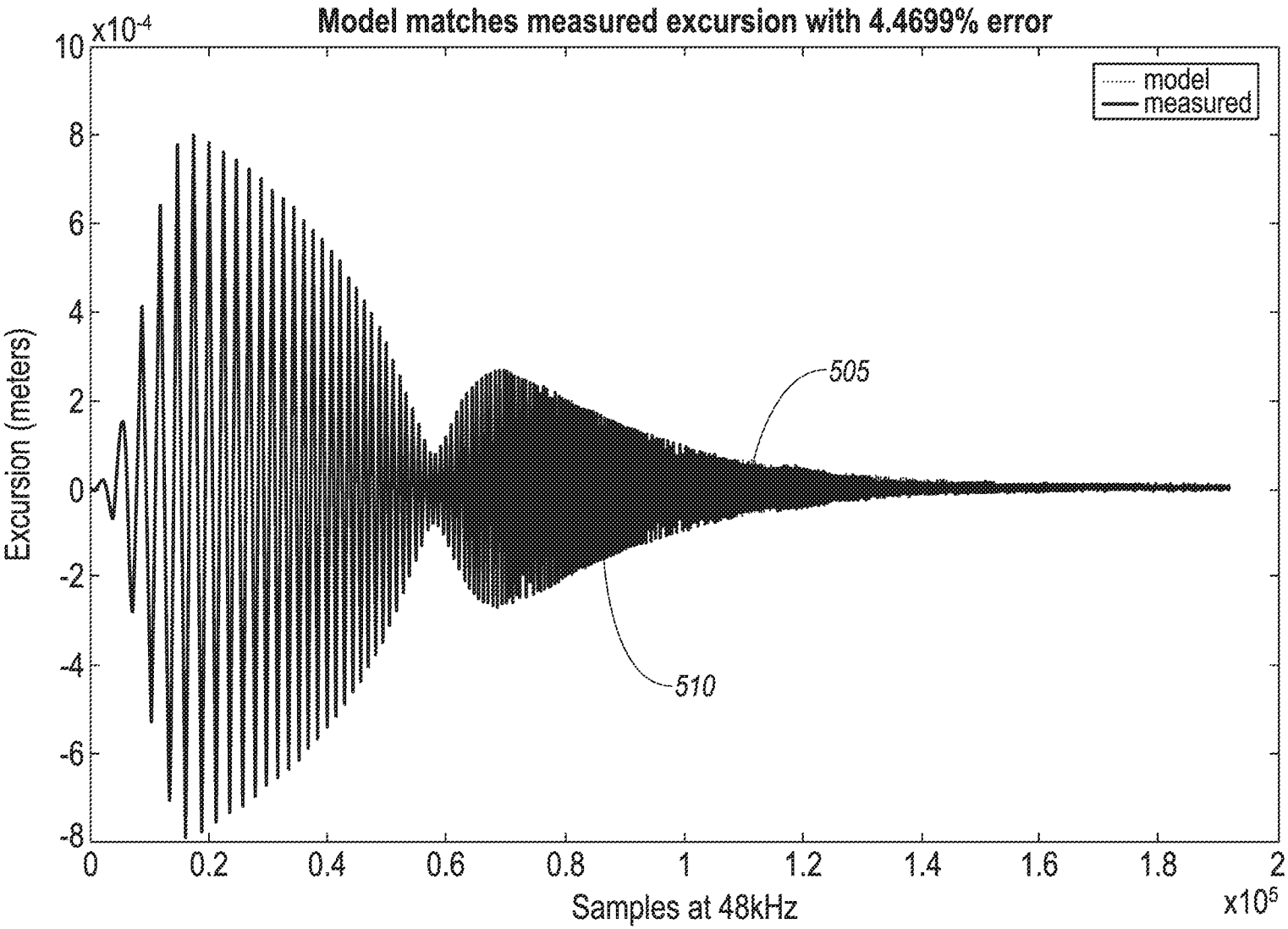
FIG. 5A illustrates a graph of the estimated vented box parameters for a mid-level voltage.
Figure 5B:
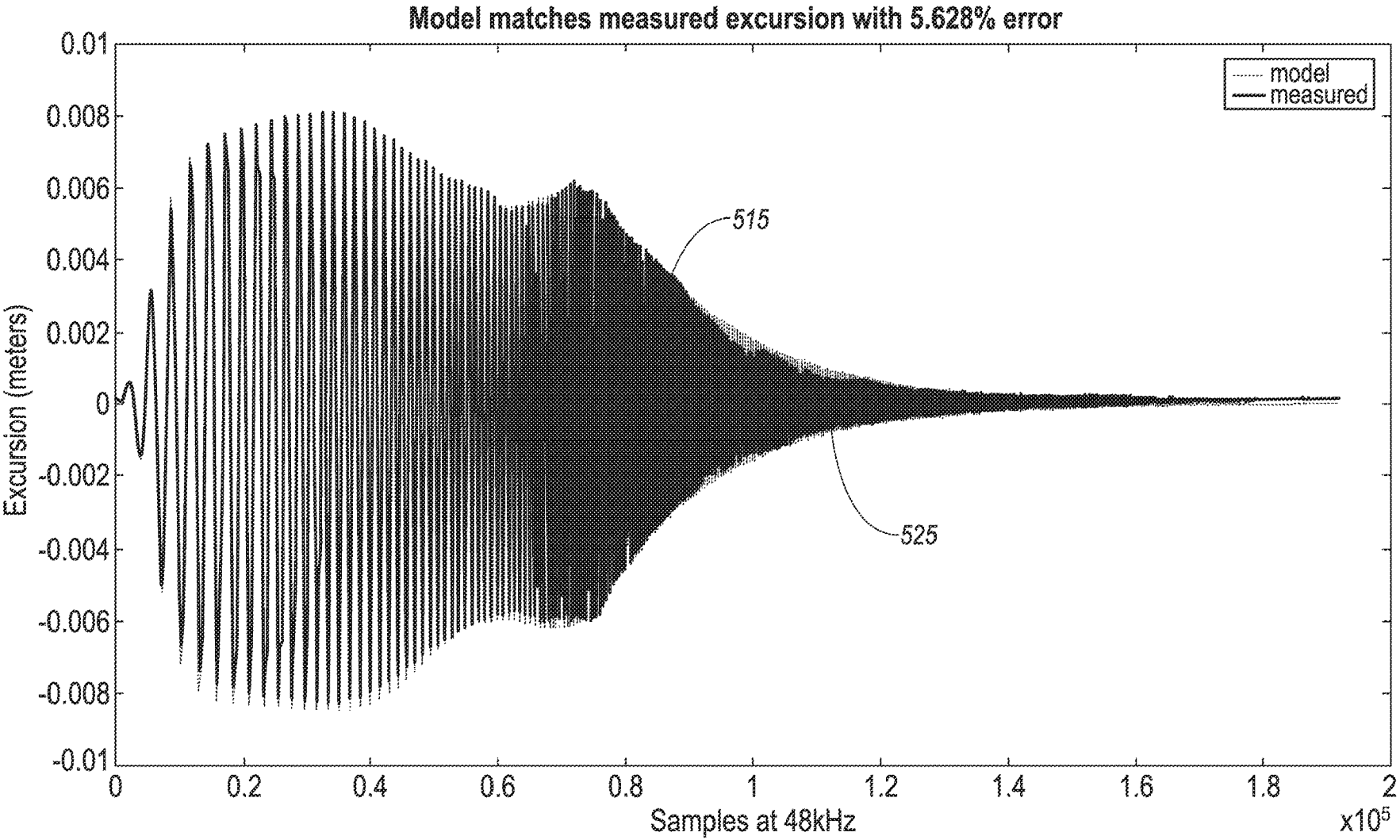
FIG. 5B illustrates a graph of the estimated vented box parameters for a high-level voltage.

FIGS. 5A-5B illustrate examples of modeled displacement using the methods of disclosed herein. These are plots of the modeled displacement versus the measured displacement. FIG. 5A illustrates a graph of the estimated vented box model for a lower voltage level. The graph illustrates the modeled excursion 505 and the measured excursion 510. As illustrated, the modeled excursion 505 is within a small degree of error of the measured excursion. The normalized root mean squared error is reported for the difference between modeled versus measured. A low error means the match is good.

In the example shown in FIG. 5A, the linear start parameters are:

Blexp=11.13 N/A (Newton/Ampere);

$K_{ms}$=3531.9 N/m;

$L_e$=4.2e-16, or zero value;

$R_{ms}$=3.50978 N·s/m;

$M_{ms}$=0.049865 kg; and $R_e$=5.3 ohms.

The vented box parameters are:

$R_a$=615 N·s/m$^5$;

$M_a$=13.54 kg/m$^2$;

$S_d$=0.055155 m$^2$; and $C_b$=8.92e-7 m$^5$/N.

Figure 5C:
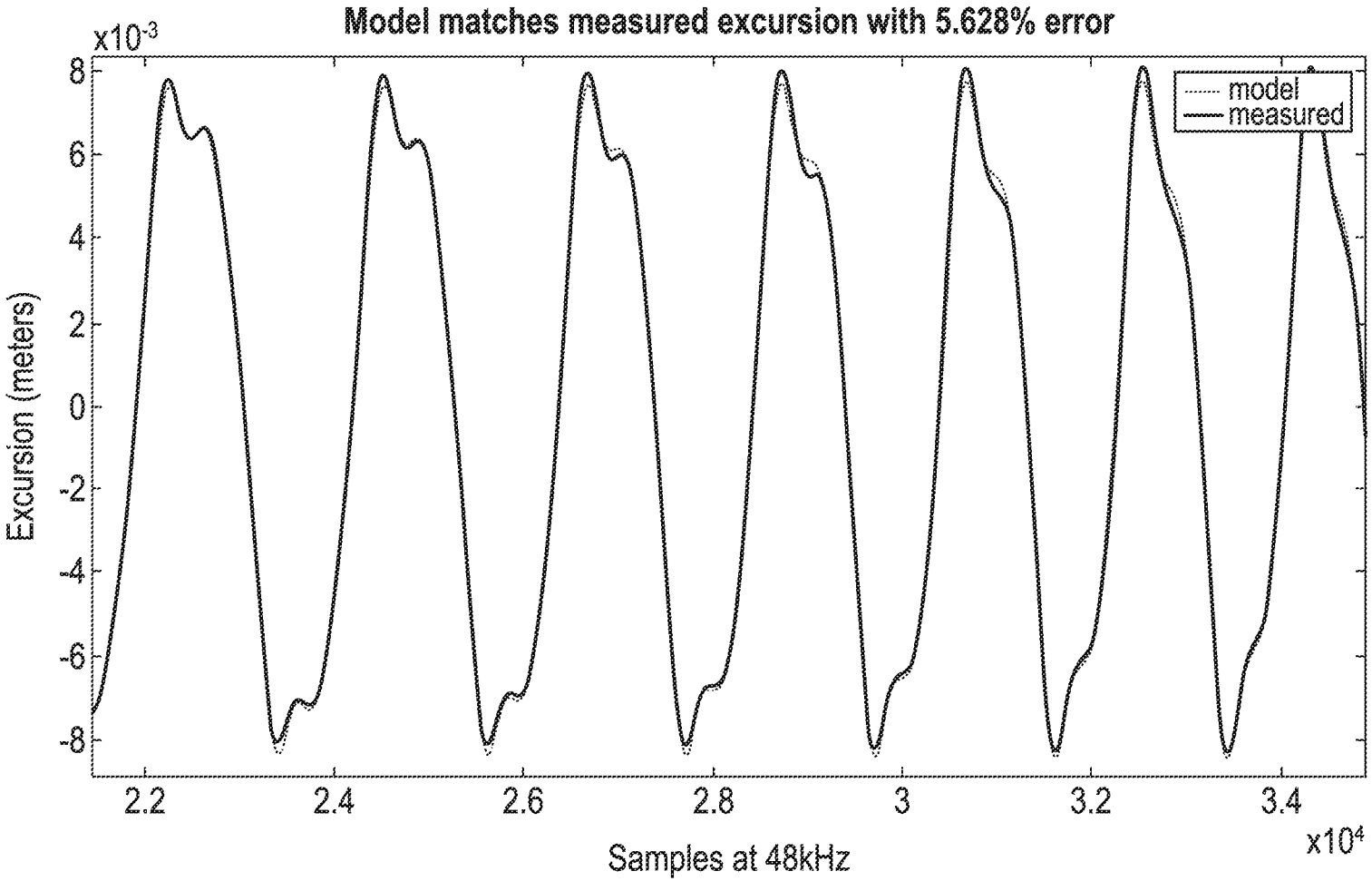
FIG. 5C illustrates a zoomed in plot for a linear match to show error in overlaid waveforms. Blue is modeled displacement; orange is measured displacement.

FIG. 5B illustrates a graph of the estimated vented box parameters for a high-level voltage, for example, 28V RMS. The graph illustrates the modeled excursion 525 and the measured excursion 530. As illustrated, the modeled excursion 525 is within a small degree of error of the measured excursion 530. In the example shown in FIG. % B, the linear start parameters may be the same as the example in FIG. 5A, except for $R_e$ which may be 5.9. The vented box parameters may be:

$R_a$=3010 N·s/m$^5$;

$M_a$=11.12 kg/m$^2$;

$S_d$=0.055155 m$^2$;

$C_b$=8.92e-7 m$^5$/N;

FIG. 5C shows a zoomed in plot for a linear match to show error in overlaid waveforms. Blue is modeled displacement; orange is measured displacement.

The acoustic resistance $R_a$ varies from 615 to 2197 to 3000 N·s/m$^5$ at 4 Vp, 20 Vp, 40 Vp, respectively. The acoustic mass $M_a$ varies from 13.54 to 11.12 to 11.12 kg/m$^2$ at 4 Vp, 20 p, 40 Vp, respectively and may reach a maximum at 20V.

As illustrated by FIGS. 5A-5C, a generalized model may be used having the same or similar input parameters. The acoustic resistance $R_a$ and acoustic mass $M_a$ affect the sweep signals in that the shape of the curve alters as the acoustic resistance $R_a$ and acoustic mass $M_a$ are varied. As the voltage increases, the nulling at port tuning (0.6 on X axis) decreases. The sweep signals of FIGS. 5A, 5B, and 5C achieve nominal errors of 4.19%, 4.48%, and 6.425%, respectively.

Figure 6:
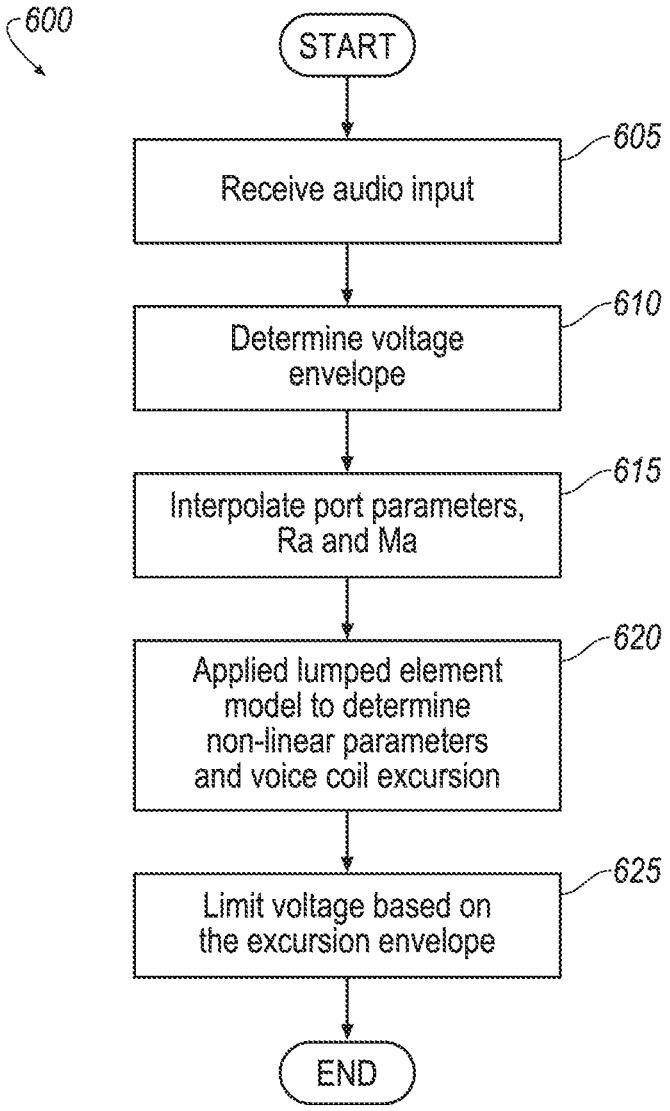
FIG. 6 illustrates an example process for the example excursion modeling system of FIG. 2.

FIG. 6 illustrates an example process 600 for the example excursion modeling system 100 of FIG. 2. The process 600 may begin at block 605 where the controller 116 may receive an input audio signal.

At block 610, the controller 116 may determine the voltage envelope of the input audio signal.

At block 615, the controller 116 may determine or interpolate the port parameters, including the acoustic resistance $R_a$ and acoustic mass $M_a$ for the specific voltage level. This may be accomplished by using a look-up table, and/or a smooth function, curve-fit of the peak input voltage level of the audio input signal.

At block 620, the controller 116 may use the port parameters to determine the voice coil excursion. The controller 116 may also determine other linear and non-linear speaker parameters.

At block 625, the controller 116 may limit the voltage based on the excursion envelope to protect the speaker from large displacement which could cause damage to the loudspeaker or create excessive distortion. The process 660 may then end.

Thus, by monitoring the input level in a model, assumed values for the acoustic resistance $R_a$ and acoustic mass $M_a$ may be estimated from the vented box model. Acoustics compliance Cb may be fixed to a single value. The vented box model may use input voltage tracking and mapping of the acoustic resistance $R_a$ and acoustic mass $M_a$ to the input voltage to generate the vented box parameters. $R_e$ may be a characterized function of temperature for model accuracy.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A loudspeaker parameter system for vented box excursion modeling, comprising:
- a loudspeaker driver having a conductor, a magnet and a diaphragm;
- a processor for excursion modeling configured to:
  - receive an input signal,
  - determine a voltage level of the input signal based on an envelope detector,
- an enclosure having a resonant port,
  - estimate port parameters including at least one of an acoustic resistance or acoustic mass, and
  - apply a voltage limit based on the vented box excursion model utilizing the port parameters.

2. The system of claim 1, wherein the port parameters are estimated at a specific voltage level.

3. The system of claim 1, wherein the port parameters are estimated using a look-up table.

4. The system of claim 1, wherein the port parameters are estimated by curve fitting the peak input voltage level of the input signal.

5. The system of claim 1, wherein conductor is a voice coil having a voice coil excursion, and further wherein the processor is further configured to apply a lumped element model to the input signal to determine the state of the port parameters and the voice coil excursion, wherein the voltage limit is based at least in part on the voice coil excursion.

6. The system of claim 5, wherein the lumped element model is based on a DC resistance received from a thermal model.

7. A method for modeling parameters of a vented box loudspeaker, comprising:
- receiving an input signal,
- determining a voltage level of the input signal,
- interpolating port parameters including at least one of an acoustic resistance and acoustic mass, and
- applying a voltage limit based on the port parameters.

8. The method of claim 7, wherein the voltage level is determined by an envelope detector.

9. The method of claim 7, wherein the port parameters are estimated at a specific voltage level and are voltage dependent.

10. The method of claim 9, wherein the port parameters are estimated by curve fitting the peak input voltage level of the input signal.

11. The method of claim 9, further comprising applying a lumped element model to the input signal to determine parameters and a voice coil excursion, wherein the voltage limit is based at least in part on the voice coil excursion.

12. The method of claim 11, wherein the lumped element model is based on a DC resistance received from a thermal model.

13. The method of claim 9, determining a driver resistance and delta temperature based on at least one of the voltage and current of the input signal.

14. The method of claim 7, wherein the port parameters are estimated using a look-up table.

15. A loudspeaker parameter system, comprising:
- a loudspeaker having a transducer and a diaphragm;
- a processor for excursion modeling configured to:
  - receive an input signal,
  - determine the voltage level of the input signal,
  - interpolate port parameters including an acoustic resistance and acoustic mass, and
  - apply a voltage limit to limit excursion based on the port parameters.

16. The system of claim 15, wherein the voltage level is determined by an envelope detector.

17. The system of claim 15, wherein the acoustic resistance and acoustic mass are estimated at a specific voltage level.

18. A loudspeaker parameter system for vented box driver excursion modeling, comprising:
- a loudspeaker driver having a coil, a magnet and a diaphragm;
- a processor for excursion modeling configured to:
  - receive an input signal,
  - determine a voltage input of the input signal,
  - estimate port parameters including an acoustic resistance and acoustic mass based on a look-up table, and
  - apply a voltage limit based on the vented box excursion model utilizing the nonlinear port parameters.

* * * * *